US006340950B1

(12) United States Patent
Smith

(10) Patent No.: US 6,340,950 B1
(45) Date of Patent: Jan. 22, 2002

(54) DISC ANTENNA SYSTEM

(75) Inventor: Stephen H. Smith, Leucadia, CA (US)

(73) Assignee: Smith Technology Development, LLC., San Diego, CA (US)

( * ) Notice: Subject to any disclaimer, the term of this patent is extended or adjusted under 35 U.S.C. 154(b) by 0 days.

(21) Appl. No.: 09/437,892

(22) Filed: Nov. 9, 1999

Related U.S. Application Data

(60) Provisional application No. 60/240,949, filed on Nov. 9, 1998.

(51) Int. Cl.[7] ..... H01Q 1/38
(52) U.S. Cl. ..... 343/700 MS; 343/857
(58) Field of Search ..... 343/769, 700 MS, 343/799, 797, 857; H01Q 13/00

(56) References Cited

U.S. PATENT DOCUMENTS 4,987,421 A * 1/1991 Sunahara et al. .... 343/700 MS
5,714,961 A 2/1998 Kot et al. ..... 343/769

FOREIGN PATENT DOCUMENTS

JP 10-200325 8/1998

* cited by examiner

*Primary Examiner*—Michael C. Wimer
(74) *Attorney, Agent, or Firm*—Kenyon & Kenyon

(57) ABSTRACT

A antenna system is provided, including a substantially annular antenna element having an inner perimeter edge. The antenna system also includes a two-dimensional amplifier system coupled to the inner perimeter edge of the antenna element. The two-dimensional amplifier system may comprise a plurality of one-dimensional amplifiers, each one-dimensional amplifier being coupled to the inner perimeter edge of the antenna element at substantially equally spaced angular positions. The two-dimensional amplifier system may also comprise a two-dimensional field effect transistor. The antenna element and two-dimensional amplifier system are configured to either receive or transmit a wave having a carrier frequency and an electric field vector, the terminus of which traces a nonlinear path within a plane transverse to an axis of wave propagation at an angular velocity corresponding to a rotation frequency between the carrier frequency and zero.

14 Claims, 9 Drawing Sheets

DISC ANTENNA SYSTEM

CROSS-REFERENCE TO RELATED APPLICATIONS

This application claims priority to U.S. Provisional Application Ser. No. 60/240,949, filed Nov. 9, 1998. The present invention is related to U.S. patent application Ser. No. 08/853,833, entitled "Communications System" and filed on May 9, 1997, now U.S. Pat. No. 6,204,810, and to U.S. patent application Ser. No. 09/064,525, entitled "Communications System" and filed on Apr. 23, 1998, now U.S. Pat. No. 6,271,790, the entire contents of which are hereby incorporated by reference.

This application is related to the subject matter of the following U.S. Provisional applications filed concurrently: Ser. No. 60/150,703 entitled "Adjustable Balanced Modulator," Ser. No. 60/145,571 entitled "System For Measuring and Displaying Three-Dimensional Characteristics of Electromagnetic Waves," Ser. No. 60/135,098 entitled "A Method and Apparatus For Two Dimensional Filtering In A Communications System Using A Transformer System," Ser. No. 60/145,744 entitled "Cavity-Driven Antenna System," and Ser. No. 60/240,949 entitled "Disc Antenna System." Ser. No. 60/107,660 entitled "Two-Dimensional Amplifier," Ser. No. 60/107,659 entitled "Phase Shifting Systems," and Ser. No. 60/107,661 entitled "Omnidirectional Array Antenna System."

FIELD OF THE INVENTION

The present invention relates to antenna systems. More particularly, the present invention relates to a disc antenna system.

BACKGROUND OF THE INVENTION

U.S. patent application Ser. No. 09/064,525, entitled "Communications System" and filed on Apr. 23, 1998, discloses a receiver system configured to receive a wave having a carrier frequency and an electric field vector, the terminus of which traces a nonlinear path within a plane transverse to an axis of wave propagation at an angular velocity corresponding to a rotation frequency between the carrier frequency and zero. FIG. 2 illustrates the path 99 traced by the extremity of such a rotating vector 96 that propagates along an axis 98. As shown in FIG. 1, such a wave, referred to herein as a "rotating" wave, can be received using three separate coplanar dipole (or monopole) antennas 10, 20, 30. The three dipole antennas may be, for example, separated by 120°.

Three taps 15, 25, 35—each located on a different one of the one of the dipole antennas 10, 20, 30—produce three signals, such as the signals 101, 102, 103 shown in FIG. 3. The three signals are then amplified by an amplifier system 40. Although a single block is used to represent the amplifier system 40 in FIG. 1, three individual amplifiers, such as three Low Noise Amplifiers (LNAs), may be used. Each LNAs is "one-dimensional" in that each amplified signal does not reflect the amplitude and orientation of the received wave. The entire amplifier system 40 (such as the three LNAs taken together), however, is "two-dimensional" because a complete picture of the amplitude and orientation of the received wave is maintained.

A nonlinear periodic path demodulator 50 receives the amplified signal (such as the three individual amplified signals), as well as information from a nonlinear period path frequency source 60. The amplified signal is demodulated with respect to the nonlinear period path and can then be demodulated by an information demodulator 70. The information signal or signals contained in the received wave can then be reproduced.

Although FIG. 1 illustrates a receiver system using three dipole antennas 10, 20, 30, a different number of dipoles can be used instead. For example, four dipoles separated by 90° could be used to receive the wave. Moreover, the signal received by each dipole is added coherently while the noise received by each dipole is added incoherently. Thus, increasing the number of dipoles can improve the Signal-to-Noise Ratio (SNR) the receiver system.

Although increasing the number of dipoles improves the SNR, such an approach has disadvantages. For example, each dipole will generally require separate electronic components, such as separate LNAs, to process the signal associated with that dipole. That is, the use of 360 dipoles, each separated by 1°, would create a sensitive receiver system but would also require the use of 360 separate LNAs. Such a system would be both difficult and expensive to create.

Moreover, the separation between dipoles must be accurately maintained. With a three-dipole system, such as the one shown in FIG. 1, each dipole must be separated by substantially exactly 120°. With different numbers of dipoles and/or different spacing between the dipoles, the physical separation must likewise relate to the phase differences in the modulation envelopes of the received signals. As the number of dipoles increases, maintaining the accuracy of the separation between the dipoles becomes more difficult.

Although the above description relates to a receiver antennas and a receiver systems, those skilled in the art will appreciate that similar problems can arise with respect to transmitter antennas and transmitter systems.

In view of the foregoing, it can be appreciated that a substantial need exists for an accurate antenna system that solves the problems discussed above.

SUMMARY OF THE INVENTION

The disadvantages of the art are alleviated to a great extent by an antenna element having an interface portion and a two-dimensional amplifier system coupled to the interface portion of the antenna element.

According to one embodiment of the present invention, the antenna element is substantially an annular antenna element and an inner perimeter edge of the antenna element is coupled to the two-dimensional amplifier system. The two-dimensional amplifier system may comprise a plurality of one-dimensional amplifiers, each one-dimensional amplifier being coupled to the inner perimeter edge of the antenna element at substantially equally spaced angular positions. The two-dimensional amplifier system may also comprise a two-dimensional field effect transistor. The antenna element and two-dimensional amplifier system are configured to either receive or transmit a wave having a carrier frequency and an electric field vector, the terminus of which traces a nonlinear path within a plane transverse to an axis of wave propagation at an angular velocity corresponding to a rotation frequency between the carrier frequency and zero.

With these and other advantages and features of the invention that will become hereinafter apparent, the nature of the invention may be more clearly understood by reference to the following detailed description of the invention, the appended claims and to the several drawings attached herein.

DETAILED DESCRIPTION

Figure 1:
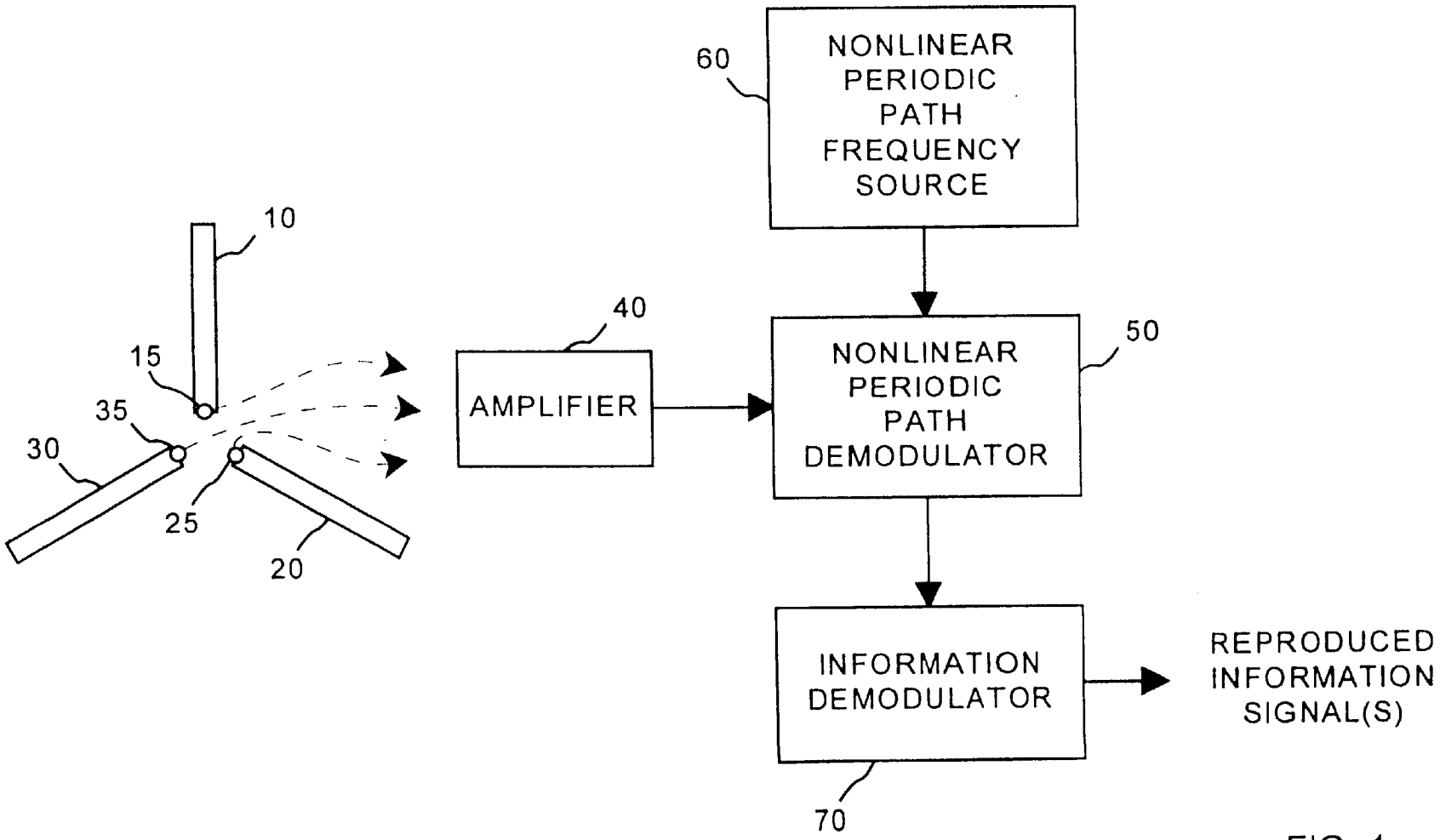
FIG. 1 is a block diagram of a receiver system configured to receive a rotating wave.

The present invention is directed to a disc antenna. Referring now in detail to the drawings wherein like parts are designated by like reference numerals throughout, there is illustrated in FIG. 4 a block diagram of a receiver system configured to receive an electromagnetic wave using a disc antenna 100 according to an embodiment of the present invention.

Figure 2:
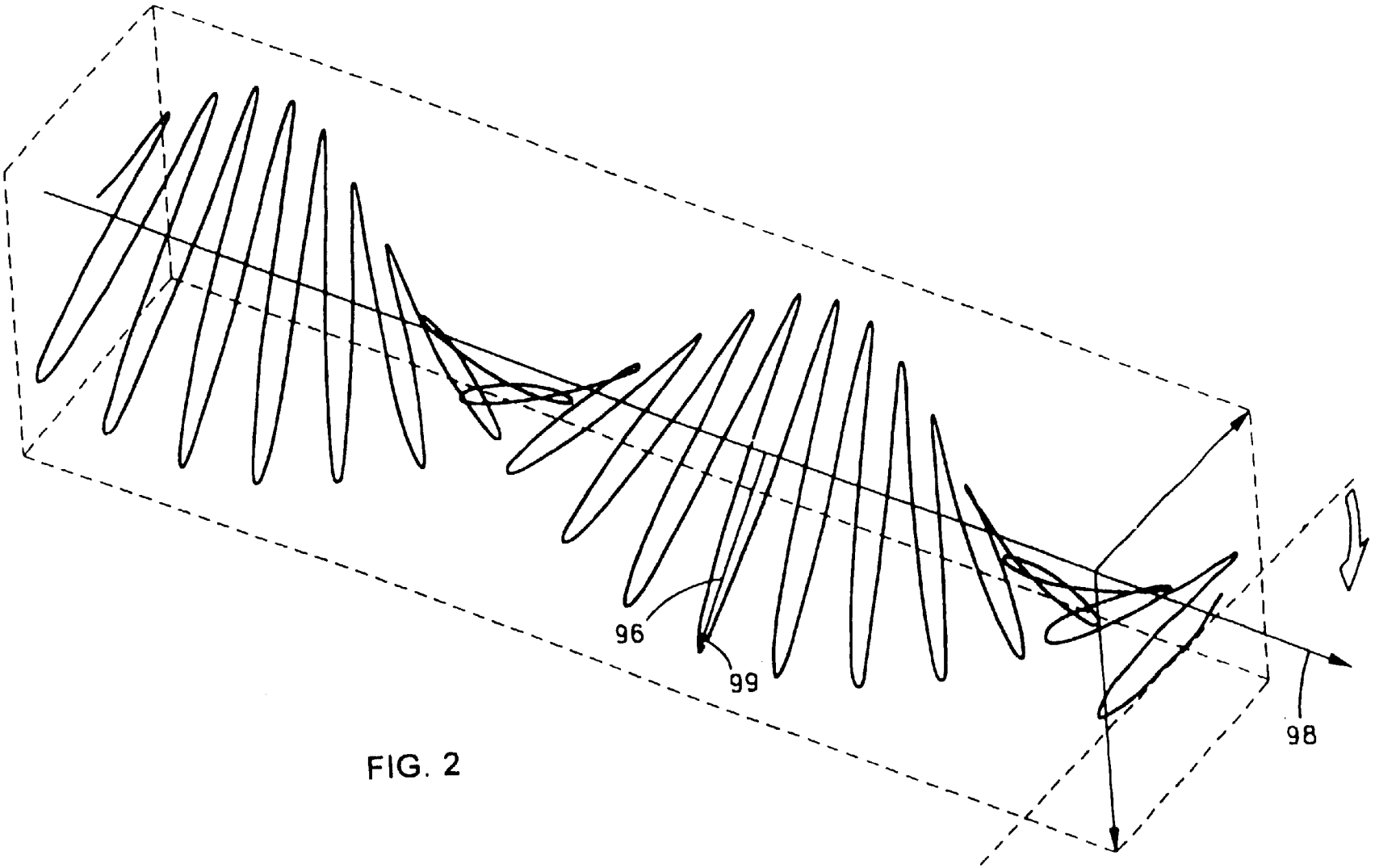
FIG. 2 illustrates the path traced by a rotating wave.
Figure 4:
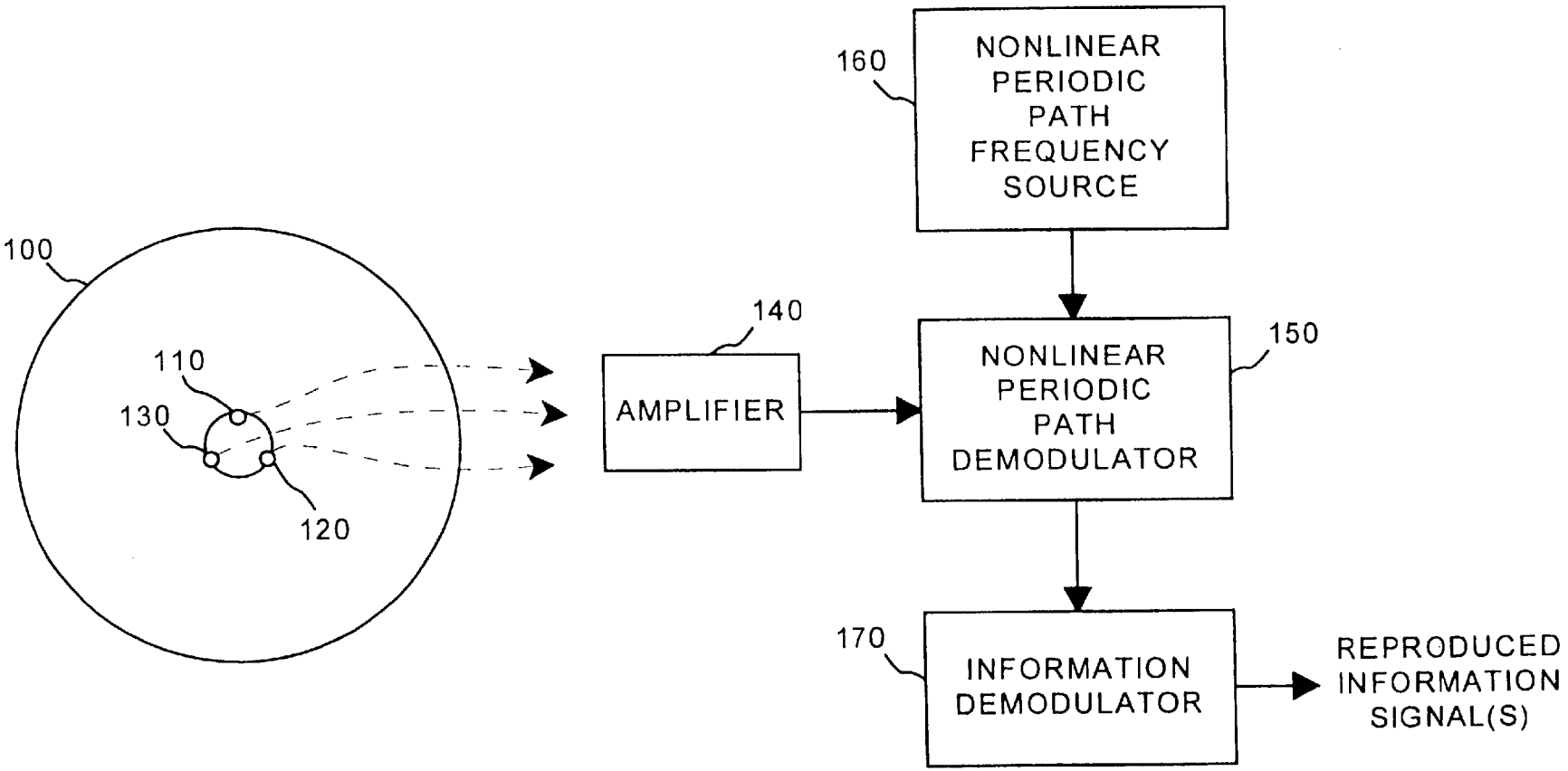
FIG. 4 is a block diagram of a receiver system configured to receive a wave using a disc antenna according to an embodiment of the present invention.

As shown in FIG. 4, a passive disc antenna 100 can be used to receive a wave such as the wave shown in FIG. 2. As used herein, the "disc" antenna 100 may be, for example, a substantially planar annular antenna having an outer perimeter edge and an inner perimeter edge. Three taps 110, 120, 130 may be placed, for example, on the inner perimeter edge of the disc antenna 100 and the taps 110, 120, 130 can be separated by 120°. Although the taps are shown attached to the inner perimeter edge of the disc antenna 100, the taps could instead be attached, for example, away from this inner edge, or in radial slots provided near the center of a solid disc.

The three taps 110, 120, 130 provide three separate signals that can be amplified by an amplifier system 140. Although a single block is used to represent the amplifier system 140 in FIG. 4, three individual amplifiers, such as three LNAs, can be used.

A nonlinear periodic path demodulator 150 receives the amplified signal (such as three separate amplified signals), as well as a signal from a nonlinear period path frequency source 160, which may provide a Local Oscillator (LO) for demodulation at a given rate. The amplified signal is demodulated with respect to the nonlinear period path signal and can then be demodulated by an information demodulator 170. The information signal or signals contained in the received wave can then be reproduced.

Figure 5:
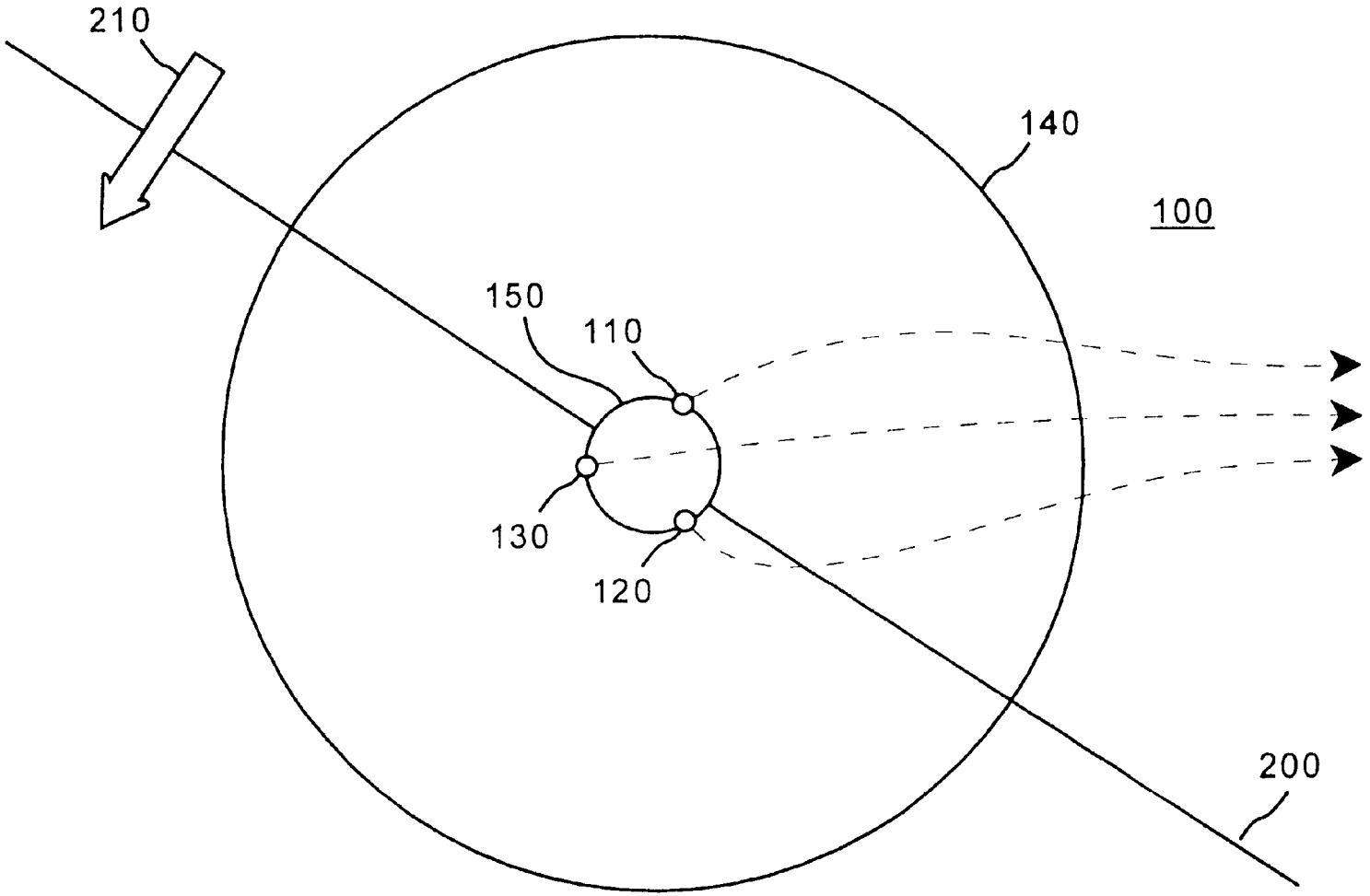
FIG. 5 is a disc antenna according to an embodiment of the present invention.

A more detailed explanation of the operation of the disc antenna 100 will now be provided with respect to FIG. 5, which shows the disc antenna 100 according to an embodiment of the present invention. The disc can comprise, for example, solid aluminum or any other material suitable for an antenna. As was the case in FIG. 4, the three taps 110, 120, 130 can be located on an inner perimeter edge 150 of the disc antenna 100. Unlike the three dipole antenna system shown in FIG. 1, any number of taps may be placed on the inner perimeter edge 150 of the disc antenna 100.

According to an embodiment of the present invention, the inner perimeter edge 150 is circular and concentric with a circular outer perimeter edge 140. Moreover, the radius of the disc antenna may be at least ¼ the wavelength of the received wave, if desired, to improve the performance of the antenna. When the antenna element is not a disc, the radius of the antenna may be at least ¼ the wavelength of the received wave at some point between the taps and the outer edge of the antenna element, if desired.

The wave shown in FIG. 2 will strike the disc antenna 100 along a line 200 that rotates around the disc, such as in the direction of the arrow 210. That is, with respect to FIG. 5, an external electric wave propagating into the page and oriented along the rotating line 200 will cause the disc antenna 100 to act much like a dipole antenna along that line 200. In this way, the disc antenna 100 can act like an infinite number of dipole antennas, each associated with an infinitely small angular separation. Because the signal received by each dipole is added coherently while the noise received by each dipole is added incoherently, the SNR of the receiver system with an apparent infinite number of dipoles is improved over an antenna system with a finite number of dipoles.

In addition, the disc antenna 100 acts as a "flywheel" and receives all of the energy from a wave propagating into the page, regardless of the wave's orientation. This increases the performance of the antenna as compared to the system shown in FIG. 1. Moreover, configurations that can be created using multiple three dipole antennas, such as an antenna array, can be similarly created using multiple disc antennas 100.

Figure 6:
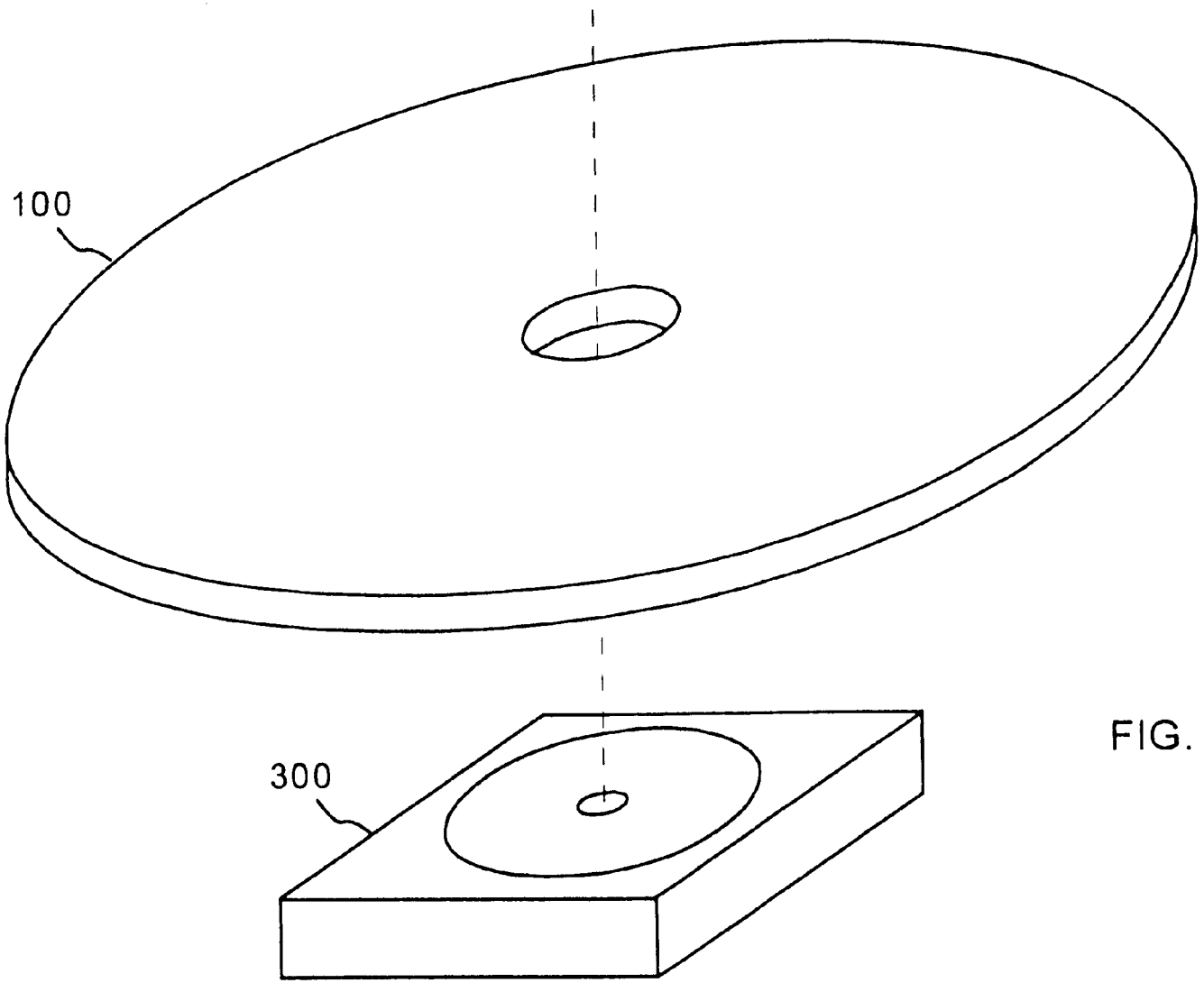
FIG. 6 is a perspective view of a disc antenna coupled to a two-dimensional amplifier according to an embodiment of the present invention.

FIG. 6 is a perspective view of the disc antenna 100 coupled to a two-dimensional amplifier 300 according to an embodiment of the present invention. Such a two-dimensional amplifier 300 is disclosed in U.S. Provisional Patent Application Ser. No. 60/107,660 entitled "Two-Dimensional Amplifier" and filed on Nov. 9, 1998. According to this embodiment of the invention, a disc antenna acting as an infinite number of dipoles can interface with a single device acting as an infinite number of LNAs. In this way, the SNR improvement of the disc antenna 100 is not lost during amplification, and the problems of accurately separating the actual dipoles and/or the cost and complexity of a large number of LNAs are eliminated.

The two-dimensional amplifier 300 can be, for example, coupled directly to the back of the disc antenna 100. As described in U.S. Provisional Patent Application Ser. No. 60/107,660 entitled "Two-Dimensional Amplifier" and the disclosure of which is incorporated herein by reference, it is desirable that the impedance of the two-dimensional amplifier 300 be matched as closely as possible with the impedance of the disc antenna 100, and different devices such as a tube, ring-shaped or cone-shaped coupling device can be used to match these impedances.

Figure 7:
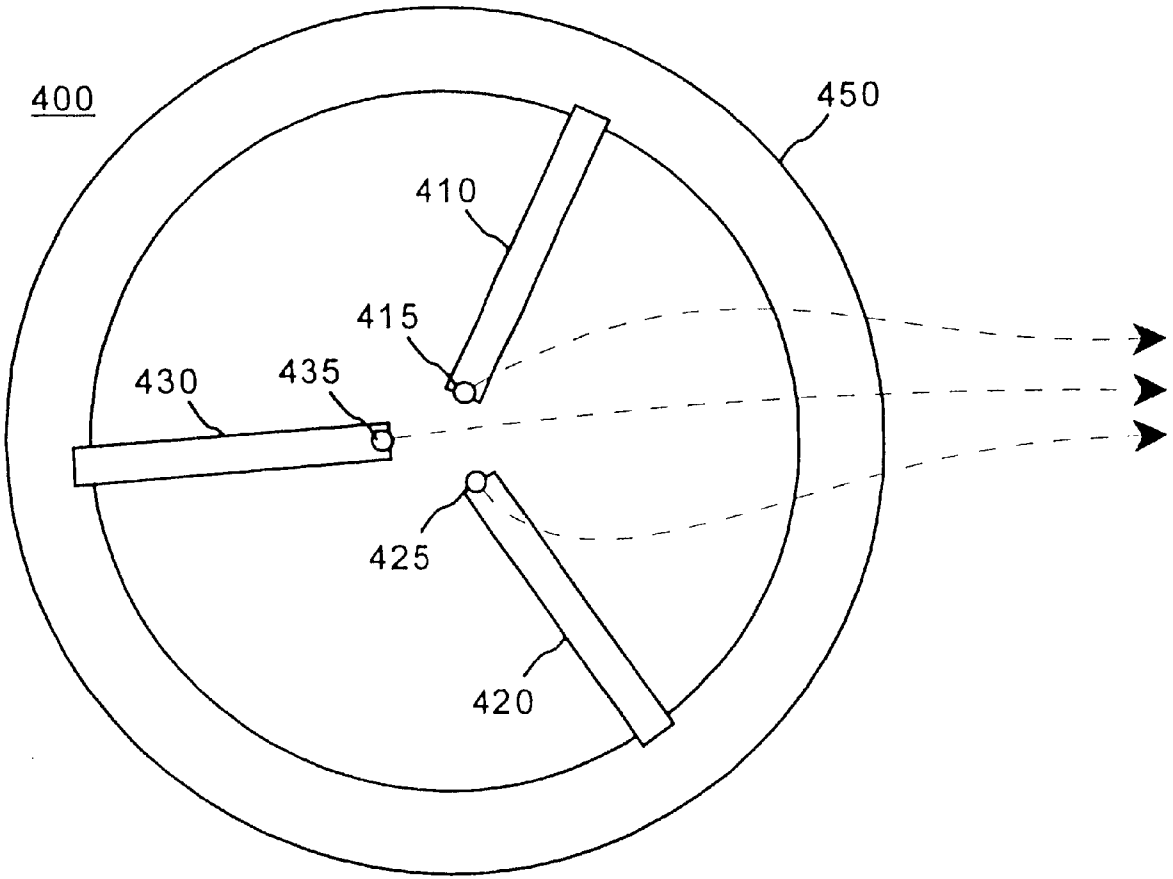
FIG. 7 is a disc antenna according to another embodiment of the present invention.

FIG. 7 is a disc antenna 450 according to another embodiment of the present invention. According to this embodiment, the disc antenna 450 includes a plurality of radial elements 410, 420, 430 interconnected by at least one circumferential element 450. In this case, a separate tap 415, 425, 435 can be placed on each of the radial elements 410, 420, 430 and the operation of the disc antenna 450 can be similar to the operation of the antenna shown in FIG. 5.

Figure 3:
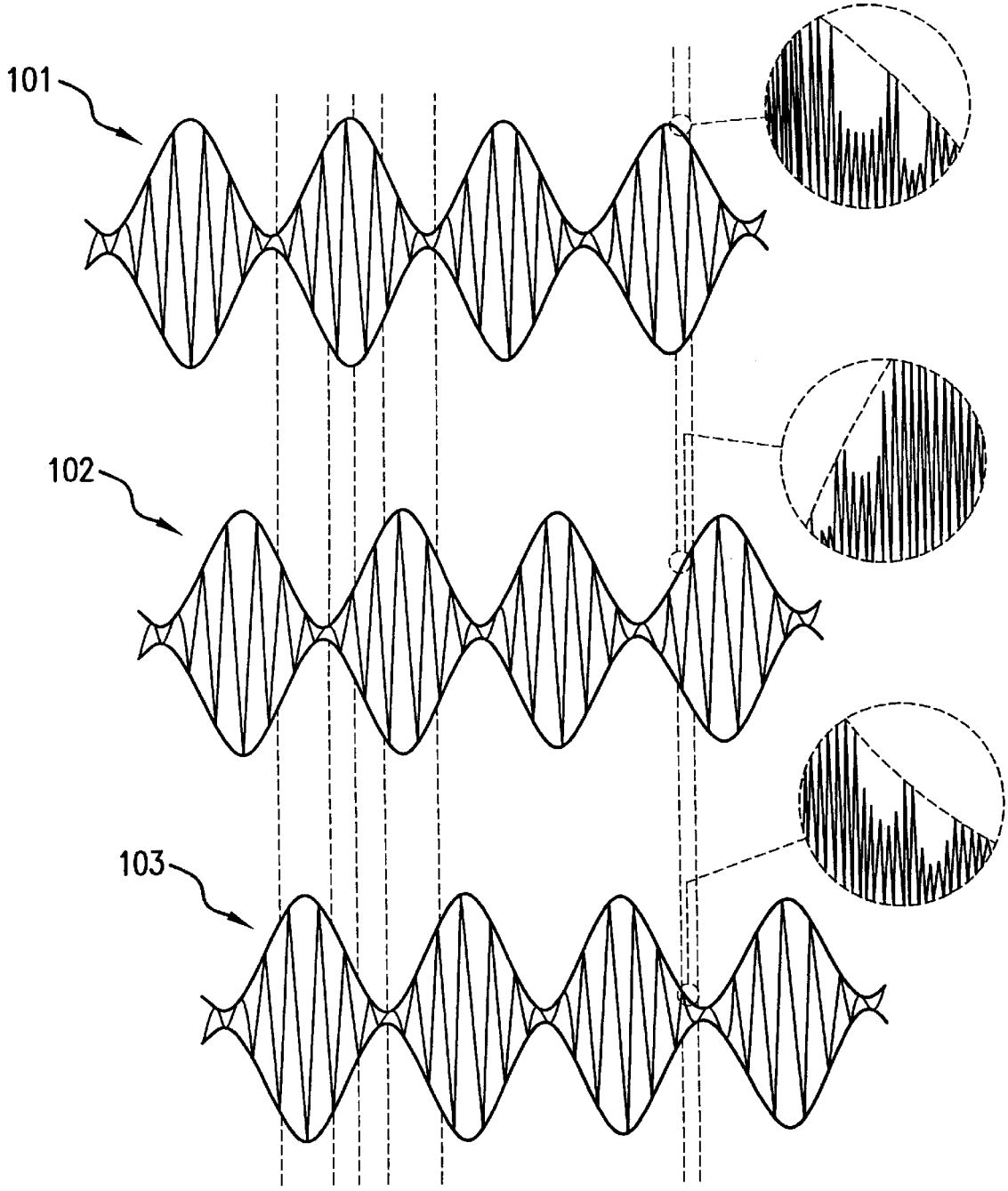
FIG. 3 illustrates the signals created at the three dipoles shown in FIG. 1 when the wave shown in FIG. 2 is received.
Figure 8:
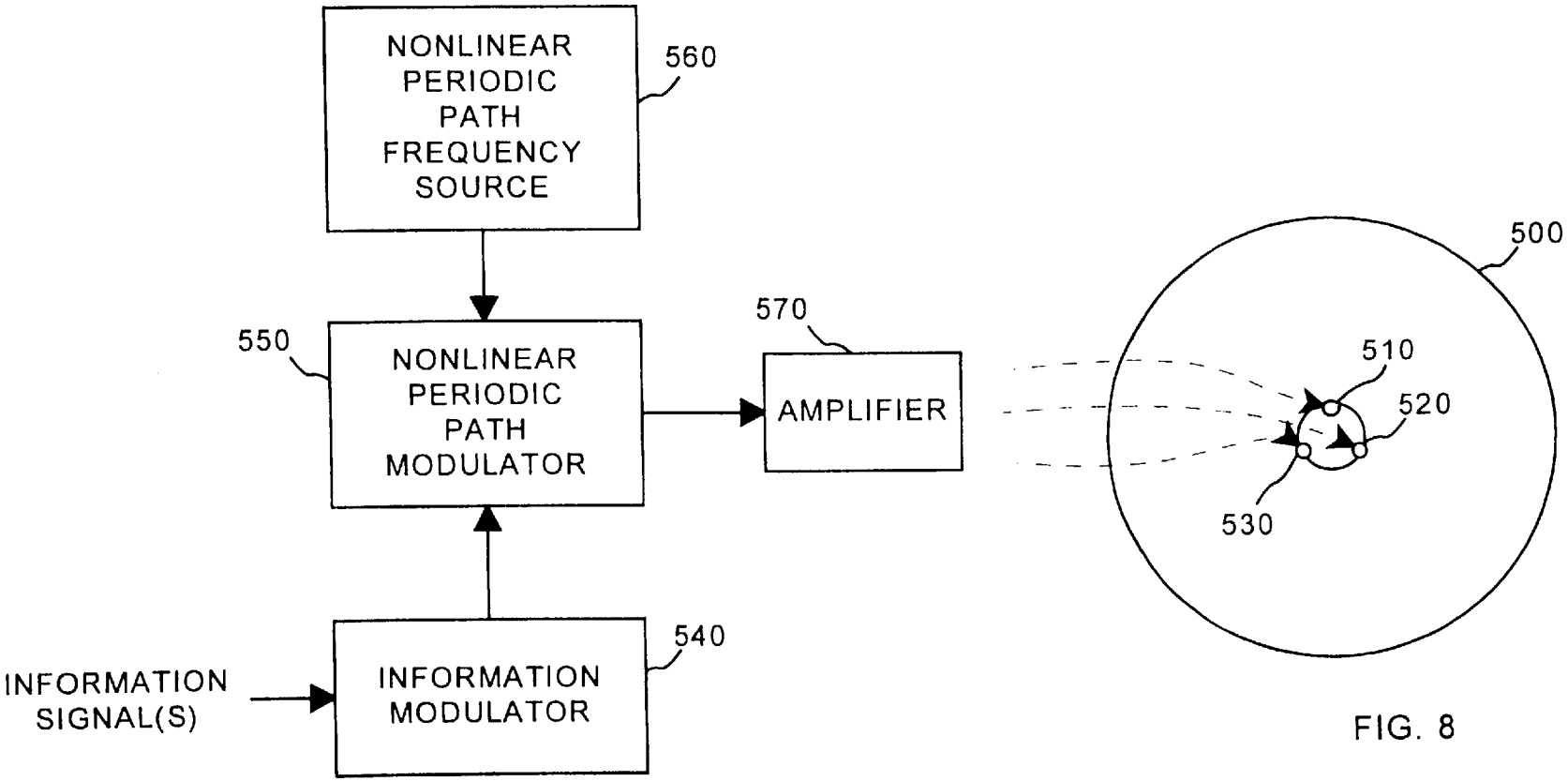
FIG. 8 is a block diagram of a transmitter system configured to transmit a wave using a disc antenna according to an embodiment of the present invention.

Although FIGS. 4–7 were described with respect to receiving a electromagnetic wave, it will be appreciated by those skilled in the art that a disc antenna may also be used to transmit an electromagnetic wave. FIG. 8 is a block diagram of a transmitter system configured to transmit a wave using a disc antenna 500 according to an embodiment of the present invention. An information signal is modulated by an information modulator 540. The modulated signal is then modulated by a nonlinear period path modulator 550 based on a signal from a nonlinear periodic path frequency source 560. The resulting signal is amplified by a two-dimensional amplifier system 570 and transmitted through a disc antenna 500, such as by driving the disc antenna 500 with three separate signals through three taps 510, 520, 530. The three signals may, for example, be similar to those shown in FIG. 3. Such a system may transmit certain waves, such as the wave shown in FIG. 2, more efficiently as compared to a transmitter system using actual dipoles.

Figure 10:
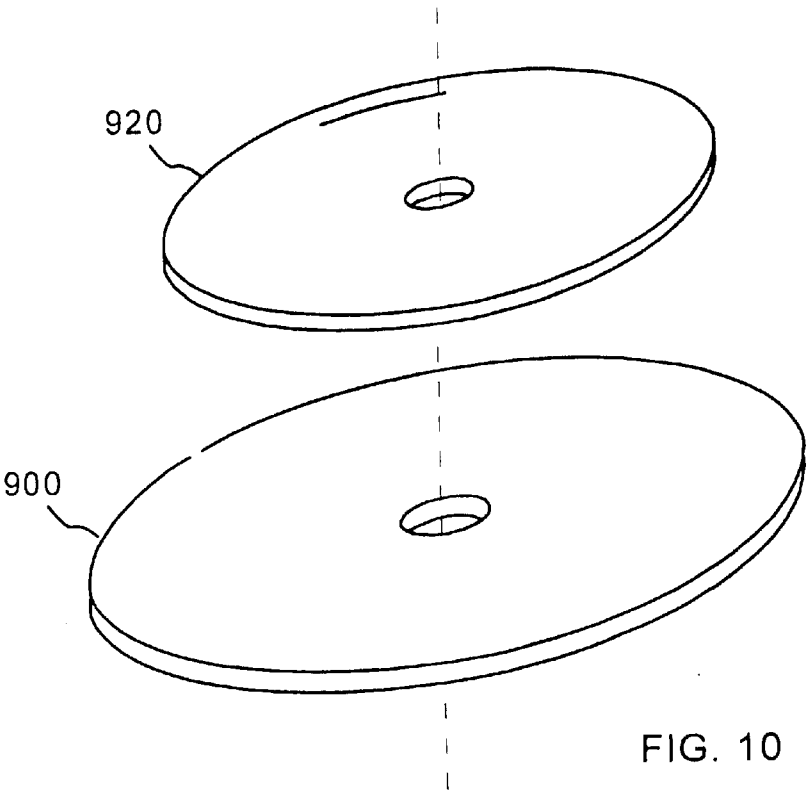
FIG. 10 illustrates an antenna system comprising a number of disc antenna elements according to an embodiment of the present invention.
Figure 9:
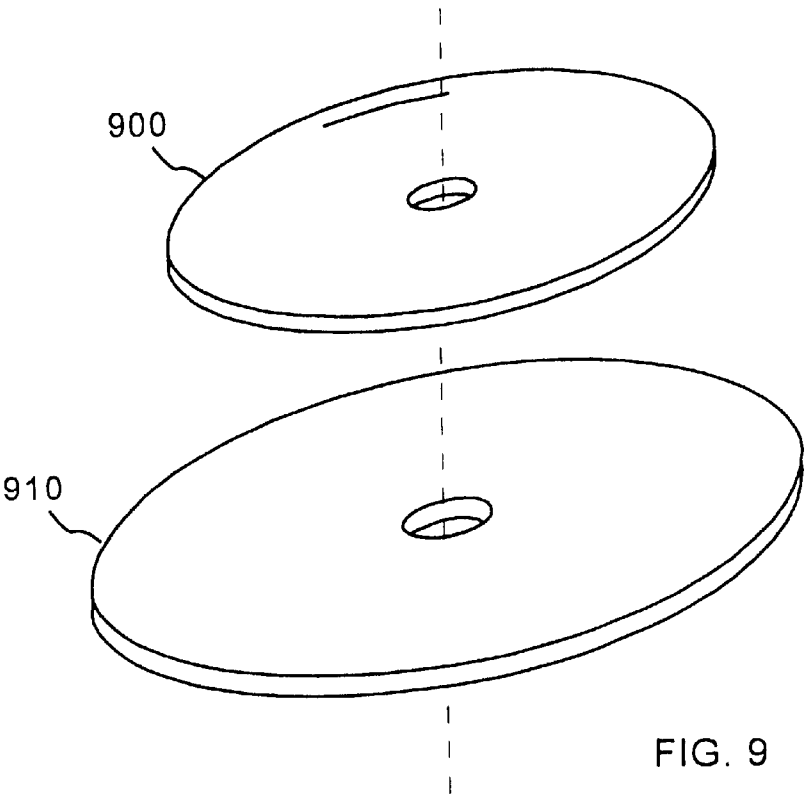
FIG. 9 illustrates an antenna system comprising a number of disc antenna elements according to an embodiment of the present invention.

Although the antenna systems described herein have comprised a single disc antenna element, it will be appreciated by those skilled in the art that antenna systems can also comprise multiple disc antenna s. FIG. 9 illustrates an antenna system comprising a number of disc antenna elements according to an embodiment of the present invention. In this case, a shorted disc 910 is located behind a driven disc antenna element 900. The shorted disc 910 may be, for example, slightly larger than the driven disc 900 and act as a reflector. FIG. 10 also illustrates an antenna system comprising a number of disc antenna elements according to an embodiment of the present invention. In this case a shorted disc 920 is placed in front of a driven disc antenna element 900. The shorted disc 920 may be, for example, slightly smaller than the driven disc 900 and act as a director.

Because a disc antenna element relates to a rotating wave in a way similar to the way a dipole antenna relates to a planar wave, known configurations of dipole antenna arrays will have a corresponding disc antenna array designs. Such designs can improve the performance of the antenna system. For example, a plurality of disc antenna elements may form a Yagi-type antenna array of passive elements. Designs related to end-fire and broad-side arrays are also within the scope of the present invention.

Although various embodiments are specifically illustrated and described herein, it will be appreciated that modifications and variations of the present invention are covered by the above teachings and within the purview of the appended claims without departing from the spirit and intended scope of the invention. For example, although specific antenna geometries were used to illustrate the present invention, it can be appreciated that other geometries may be used instead. For instance, although the disc antenna was described as a planar annulus, it will be appreciated that the a non-planar (such as a cone) or non-annulus (such as a square) geometry can be used instead. Similarly, although particular types of materials have been described with respect to the construction of disc antennas, other types of materials will also fall within the scope of the invention.

What is claimed is:

1. An antenna system, comprising:

a substantially annular antenna element having an outer perimeter edge and an inner perimeter edge comprising:

a solid conductive radiating surface defined by the region between the outer perimeter edge and the inner perimeter edge;

a central substantially circular non-conductive aperture defined by the inner perimeter edge; and a plurality of feed points at substantially equally spaced angular positions about the inner perimeter edge; and a plurality of one-dimensional amplifiers, each one-dimensional amplifier coupled to one of said feed points;

said antenna system configured to one of receive and transmit a wave having a carrier frequency and an electric field vector, the terminus of which traces a nonlinear path within a plane transverse to an axis of wave propagation at an angular velocity corresponding to a rotation frequency between the carrier frequency and zero.

2. An antenna system, comprising:

a substantially annular antenna element having an inner perimeter edge; and a two-dimensional amplifier system coupled to the inner perimeter edge of said antenna element, comprising:

a two-dimensional field effect transistor coupled to the inner perimeter edge of said antenna element;

wherein said antenna element and said two-dimensional amplifier are configured to one of receive and transmit a wave having a carrier frequency and an electric field vector, the terminus of which traces a nonlinear path within a plane transverse to an axis of wave propagation at an angular velocity corresponding to a rotation frequency between the carrier frequency and zero.

3. A method for receiving a wave having a carrier frequency and an electric field vector, the terminus of which traces a nonlinear path within a plane transverse to an axis of wave propagation at an angular velocity corresponding to a rotation frequency between the carrier frequency and zero, comprising the steps of:

receiving the wave at a substantially annular antenna element, said substantially annular antenna element having a radius of at least one-quarter wavelength of the carrier frequency; and performing a two-dimensional amplification of a signal generated in response to the received wave.

4. The method of claim 3, wherein said performing step includes the substep of:

performing a plurality of one-dimensional amplifications of a plurality of signals received from a plurality of taps coupled to said antenna element at substantially equally spaced angular positions.

5. The method of claim 3, wherein said performing step includes the substep of:

performing a two-dimensional amplification using a two-dimensional field effect transistor.

6. A method for transmitting a wave having a carrier frequency and an electric field vector, the terminus of which traces a nonlinear path within a plane transverse to an axis of wave propagation at an angular velocity corresponding to a rotation frequency between the carrier frequency and zero, comprising the steps of:

performing a two-dimensional amplification of a signal;

providing the amplified signal to a substantially annular antenna element, said substantially annular antenna element having a radius of at least one-quarter wavelength of the carrier frequency; and transmitting the wave from the antenna element.

7. The method of claim 6, wherein said performing step includes the substep of:

performing a plurality of one-dimensional amplifications of a plurality of signals.

8. The method of claim 6, wherein said providing step includes the substep of:

providing a plurality of amplified signals to an interface portion of said antenna element at substantially equally spaced angular positions.

9. An apparatus for receiving a wave having a carrier frequency and an electric field vector, the terminus of which traces a nonlinear path within a plane transverse to an axis of wave propagation at an angular velocity corresponding to a rotation frequency between the carrier frequency and zero, comprising:

means for receiving the wave at a substantially annular antenna element, said substantially annular antenna element having a radius of at least one-quarter wavelength of the carrier frequency; and means for performing a two-dimensional amplification of a signal generated in response to the received wave.

10. The apparatus of claim 9, wherein performing means includes means for performing a plurality of one-dimensional amplifications of a plurality of signals received from a plurality of taps coupled to said antenna element at substantially equally spaced angular positions.

11. The apparatus of claim 9, wherein performing means includes means for performing a two-dimensional amplification using a two-dimensional field effect transistor.

12. An apparatus for transmitting a wave having a carrier frequency and an electric field vector, the terminus of which traces a nonlinear path within a plane transverse to an axis of wave propagation at an angular velocity corresponding to a rotation frequency between the carrier frequency and zero, comprising:

means for performing a two-dimensional amplification of at least one signal;

means for providing the amplified signal to a substantially annular antenna element, said substantially annular antenna element having a radius of at least one-quarter wavelength of the carrier frequency; and means for transmitting the wave from the antenna element.

13. The apparatus of claim 12, wherein performing means includes means for performing a plurality of one-dimensional amplifications of a plurality of signals.

14. The apparatus of claim 12, wherein providing means includes means for providing the plurality of amplified signals to an interface portion of said antenna element at substantially equally spaced angular positions.

* * * * *